US005624475A

United States Patent [19]

Nadkarni et al.

[11] Patent Number: 5,624,475

[45] Date of Patent: Apr. 29, 1997

[54] COPPER BASED NEUTRON ABSORBING MATERIAL FOR NUCLEAR WASTE CONTAINERS AND METHOD FOR MAKING SAME

[75] Inventors: Anil V. Nadkarni, Chapel Hill; Jack D. Troxell, Hillsborough, both of N.C.

[73] Assignee: SCM Metal Products, Inc., Research Triangle Park, N.C.

[21] Appl. No.: 349,074

[22] Filed: Dec. 2, 1994

[51] Int. Cl.[6] ..... C22C 29/04; P22F 5/00

[52] U.S. Cl. ..... 75/238; 75/244; 75/247; 75/951; 419/14; 419/32; 419/48; 976/DIG. 328; 428/545

[58] Field of Search ..... 75/244, 247, 951, 75/238; 419/32, 48, 14; 976/DIG. 328, DIG. 329; 376/272; 250/506.1, 518.1; 428/545

[56] References Cited

U.S. PATENT DOCUMENTS

| | | | |
|---|---|---|---|
| H897 | 3/1991 | Wiencek et al. | 250/518.1 |
| 2,964,397 | 12/1960 | Cooper | 420/469 |
| 3,069,759 | 12/1962 | Grant et al. | 75/252 |
| 3,144,327 | 8/1964 | Schmidt | 420/591 |
| 3,256,072 | 6/1966 | Bull | 428/627 |
| 4,227,928 | 10/1980 | Wang | 75/238 |
| 4,253,917 | 3/1981 | Wang | 204/16 |
| 4,459,327 | 7/1984 | Wang | 427/183 |
| 4,478,787 | 10/1984 | Nadkarni et al. | 419/8 |
| 4,735,770 | 4/1988 | Schultz et al. | 419/12 |
| 4,865,645 | 9/1989 | Planchamp | 75/244 |
| 4,954,170 | 9/1990 | Fey et al. | 75/229 |
| 4,999,050 | 3/1991 | Sanchez-Caldera et al. | 75/244 |
| 4,999,336 | 3/1991 | Nadkarni et al. | 505/1 |
| 5,030,275 | 7/1991 | Samal et al. | 75/232 |
| 5,089,354 | 2/1992 | Nakashima et al. | 428/552 |

*Primary Examiner*—Ngoclan Mai
*Attorney, Agent, or Firm*—Kalow, Springut & Bressler

[57] ABSTRACT

A composite material comprising a pure copper or dispersion strengthened copper matrix and a boron rich species, such as, but not limited to, elemental boron or boron carbide, for use in the fabrication of baskets that support spent nuclear fuel in nuclear waste containers. A method for manufacturing the composite material using powder metallurgy and hot extrusion.

25 Claims, No Drawings

COPPER BASED NEUTRON ABSORBING MATERIAL FOR NUCLEAR WASTE CONTAINERS AND METHOD FOR MAKING SAME

FIELD OF THE INVENTION

This invention relates to a composite material of elemental copper or dispersion-strengthened copper (DSC) and boron for use in the fabrication of nuclear waste disposal containers for supporting spent nuclear fuel rods, nuclear waste materials and other radioactive substances and absorbing the neutron radiation emitted by those substances.

BACKGROUND OF THE INVENTION

Various attempts have been made to use materials containing copper and boron as components in nuclear waste disposal systems. Copper is a metal of choice because of its high thermal conductivity and high melting point. Boron is used because of its capability to absorb neutron radiation.

The use of copper-boron composites as components in nuclear waste disposal systems is noted in U.S. Pat. No. 4,227,928 which issued to Wang on Oct. 14, 1980. This patent discloses the use of boron carbide filled copper plate material used to line baskets for containing nuclear waste material. The Wang patent covers a process for manufacturing the plate material by electroless copper process for manufacturing the plate material by electroless copper plating particulate boron carbide core material and then electrolytically depositing additional copper on to the particles. The copper encapsulated boron carbide particles are then hot rolled, hot pressed or cold pressed and sintered to produce boron carbide filled copper shields.

A material presently used as a neutron absorber in nuclear waste containment vessels designed for the temporary storage of nuclear waste is a commercial composite material consisting of an aluminum matrix with 1.8 weight percent boron. The material is not considered a viable candidate for long term, permanent waste disposal systems because of inherently poor thermal conductivity and low strength.

Borated stainless steel is a material currently used for neutron absorption in long term nuclear waste storage containers. This material contains approximately 0.2 to 2.25 weight percent boron. While the borated stainless steel material has higher strength than the borated aluminum material, it suffers from inherently poor thermal conductivity. Unlike these known materials, the inventive material has both high strength and high thermal conductivity.

Various methods of manufacturing copper-boron alloys for purposes other than nuclear waste containment are also known to the art. For instance, U.S. Pat. No. 2,964,397, which issued to Cooper on Dec. 13, 1960, discloses copper-boron alloys produced by vacuum melting and high temperature combination of elemental copper and boron particulates.

Additionally, U.S. Pat. No. 3,144,327, which issued to Schmidt, et al. on Aug. 11, 1964, discloses copper-boron alloys produced by combining particulate elemental boron and copper under condition of high temperature and pressure.

It is also known to produce copper-boron alloys by: 1) mechanical alloying of copper-transition metal-carbon particulates whereby transition metal carbides are formed at elevated temperature for the purpose of strengthening the copper matrix, and 2) the high temperature infiltration of a tungsten skeleton with a copper-boron alloy to produce tungsten borides for the purpose of wear resistance.

SUMMARY OF THE INVENTION

The present invention is a composite material comprising a pure copper or dispersion strengthened copper (DSC) matrix and a boron rich species, such as, but not limited to, elemental boron or boron carbide, as the second phase constituent. The primary use of this material is in the fabrication of baskets that support spent nuclear fuel in nuclear waste containers.

The invention also consists of a method for combining the above described constituents of the composite material in such a manner as to provide a copper or DSC matrix with a substantially uniform distribution of the boron rich species. "Uniform distribution" is determined via microscopy—specifically, examination of the microstructure using a scanning electron microscope. While no quantitative measure of the uniformity of distribution of the boron rich species has been established, one skilled in the art will be able to visually compare the microstructure of the inventive composite material and distinguish it from materials which are clearly non-uniform. "Homogenous composite" is used interchangeably with "uniform distribution."

The manufacturing method also contains a process for producing full dense structural shapes from the composite material. "Full density" is a term used to indicate that a material is very near 100% theoretical density. No commercial material produced from powder is truly 100% dense in the strictest sense of the definition. For practical purposes, densities greater than 99.0% of theoretical density are acceptable, and are termed full dense. Densities less than 99.0% of theoretical are undesirable because the lower densities tend to decrease strength and ductility.

The basic design concept for the use of the inventive neutron absorbing material is an outer cylindrical shell with the neutron absorbing material arranged in a grid pattern in the interior of the cylinder. The components of the grid are often referred to as baskets. The spent fuel rod assemblies are placed within the grid and each is completely surrounded by the neutron absorbing material.

An object of the present invention is to provide a material with the capability to absorb neutron radiation emitted by spent nuclear fuel rods.

A further object of the present invention is to provide a material with high thermal conductivity to allow for efficient removal of heat from spent nuclear fuel rods.

Another object of the present invention is to provide a material with the high strength levels required to support spent fuel rod bundles.

DESCRIPTION OF THE PREFERRED EMBODIMENTS

While the invention will be described in connection with a preferred embodiment, it will be understood that it is not intended to limit the invention to the described embodiment. On the contrary, it is intended to cover all alternatives, modifications and equivalents as may be included within the spirit and scope of the invention as defined by the appended claims.

The present invention is a composite material comprising a pure copper or DSC matrix and a boron rich species, such as, but not limited to, elemental boron or boron carbide, as the second phase constituent. The material of the invention is well suited for nuclear fuel waste containers or other components in the nuclear waste disposal system assemblies where a material with high thermal conductivity, structural strength, and the ability to absorb neutron irradiation is desired.

The dispersion strengthened copper is a composite of elemental copper and a metal oxide. Dispersion strengthened copper is copper strengthened by an ultra-fine dispersion of particulates, or dispersoids. The particulates, once formed, do not normally react with the copper matrix, and the particulates are thermally and chemically stable at high temperatures.

A suitable DSC is available from SCM Metal Products, Inc. under the trade name GLIDCOP®. GLIDCOP AL-15 is aluminum oxide (0.3 weight percent) dispersion strengthened copper. Stable metal oxides other than aluminum oxide can be used to produce dispersion strengthened copper.

DSC provides the inventive material with increased strength as compared to elemental copper, but the use of DSC slightly lowers the thermal conductivity of the material.

The full dense material of the invention is manufactured from powders of the constituents named above. The powders, when properly combined to form a homogeneous or uniformly distributed composite material, are consolidated into a full dense structural shape by an appropriate powder consolidation method such as hot extrusion.

Consolidation of the composite powder to full density is important to the performance of the material. Less than optimum thermal conductivity and structural strength will result from incomplete densification. While it is feasible to utilize any of several powder densification processes, the preferred embodiment of this invention is densification through hot extrusion of the composite powders. Alternative methods of powder densification (consolidation) include hot isostatic pressing (HIP), cold isostatic pressing (CIP), closed die pressing, hot pressing and hot forging. Any powder densification process which provides full dense product can be used to consolidate this material.

The pure copper and, to a slightly lesser extent, the dispersion strengthened copper (DSC), provide high thermal conductivity to allow for efficient removal of heat from the spent nuclear fuel rods. Electrical conductivity is used as an indicator of the thermal conductivity of a material, and oxygen free high conductivity copper (OFHC) is considered the bench mark against which other materials are compared.

OFHC is a trade name used for two specific copper alloys—C10100 (99.99% copper with electrical conductivity of 101% IACS) and C10200 (99.95% copper with electrical conductivity of 101% IACS).

The thermal conductivity of OFHC is reported in the literature to be 391 Watts/meter/° C. typically. This level of thermal conductivity is generally considered the benchmark against which other materials are judged. Thermal conductivity is difficult and expensive to measure. It is common practice to use electrical conductivity as an indicator of the thermal conductivity. For example, it is common knowledge that a copper alloy that has an electrical conductivity of 90% IACS will have thermal conductivity approximately equal to 90% of the thermal conductivity of oxygen free copper. This relationship is valid because the mobility of the electrons in the atomic structure of a material establishes the ability of the material to conduct the heat and electricity.

The optimal level or desired range of thermal conductivity for the inventive material is dependent on the design of the containers which are to be used and the desired performance characteristics of the materials. Material selection is often a compromise, balancing strength against physical properties such as thermal conductivity. For example, materials which are normally considered high strength materials (steel, nickel alloys, some beryllium coppers) generally have low thermal conductivity, and are not used for components which must transfer heat. We have invented a material with a desirable combination of strength, thermal conductivity and neutron absorption characteristics.

Copper and DSC also provide the high strength levels required to support the spent fuel rod bundles, with the dispersion strengthened copper providing higher strength than the composite with a pure copper matrix.

Boron is added to the matrix material in the form of a stable boron rich constituent such as elemental boron or boron carbide ($B_4C$). Compounds such as boron nitride, titanium diboride, and zirconium diboride have desirable characteristics (high melting point, chemical and thermal stability) for this application. Boron carbide has the additional quality of having the highest atomic weight to molecular weight ratio of boron compounds. For example, the atomic weight of boron contained in the boron carbide ($B_4C$) is 43.2 and the molecular weight of boron carbide is 55.2. The boron/molecular weight ratio is 0.78. The same calculation for boron nitride (BN) yields a ratio of 0.44. This higher ratio of boron in boron carbide when compared to boron nitride, taken with the similar densities of these compounds, means that less actual material must be added to the copper to achieve the same boron loading in the composite. This is important because adding higher amounts of boron containing materials has an adverse effect on the properties of the composite.

Compounds such as boron carbide are preferred because they have very limited solid solubility in the pure copper or DSC matrix. The boron's key function is to absorb neutron irradiation emitted by the spent nuclear fuel rods. The boron is substantially uniformly distributed throughout the inventive composition.

In the preferred embodiment the composition contains approximately 0.5 to 3.0 weight percent boron. A composition with 1.5 weight percent boron, either in the form of elemental boron or as a constituent of $B_4C$, provides the most preferred trade off between neutron absorption performance and other properties required for nuclear waste containment.

The addition of boron to copper results in higher hardness, tensile strength and yield strength, lower ductility (which is consistent with higher strength) and lower electrical conductivity (18% lower). Because of the similarities between electrical and thermal conductivity, the thermal conductivity of copper with boron is about 18% lower than pure copper. The addition of boron to DSC results in marginally higher hardness, lower tensile and yield strength, and electrical conductivity which is lower (16%) than DSC without boron. While these results appear to indicate that the boron addition to DSC provides undesirable changes in the properties of DSC the strength for example, of DSC is very high compared to the strength of pure copper. The loss of strength resulting from the boron addition is not significant.

The invention also includes a method for manufacturing the composite material described above using techniques of powder metallurgy.

The constituents of the composite material are combined in powder form. Pure copper or DSC powder is combined with the boron or boron rich species powder and mechanically mixed, e.g., in a powder blender or milled in a high energy mill such as a ball mill. Ball milling is preferred over blending.

The materials are blended or milled for an appropriate length of time to provide a composite powder with a substantially uniformly distributed boron rich species. The milling process is controlled by variables such as the ratio of the weight of the charge (composite powder constituents) to the weight of the media (the balls in the ball mill), the media material and size, the volume of the milling media as a percentage of the total volume of the mill, the rotational speed of the mill, and the length of time the constituents are milled.

General ranges for the variables of the milling process are as follows: charge to media weight ratio of 1:5 to 1:10, spherical steel media of sizes ranging from ¼" diameter to 1" diameter, a media volume of 15 to 30% of the volume of the mill, rotational speed of 40 to 80% of the critical speed of the mill based on the diameter of the mill, and total milling times of between 4 and 24 bores.

The ratio of the various sizes of steel media refers to the exact ratio of the weight of each of the three sizes of steel balls used as milling media. One preferred media mixture, which is dependent on the established media volume (see below) consisted of ⅓ by weight ¼" diameter balls, ⅓ by weight ½" diameter balls, and ⅓ by weight ¾" diameter balls.

The "critical speed" is based on the mill diameter, and is a theoretical value describing the speed at which the mill is operating at peak efficiency. This term is normally associated with ball milling operations where powdered material is being ground to reduce the particle size. The term is used here because it serves as a reference point for discussing rotational speed. Critical speed is calculated as follows: CRITICAL SPEED=76.6 $(1/D)^{-1/2}$ where D=MILL DIAMETER in feet. The numerical value of critical speed allows milling conditions to be discussed without concern for the absolute size of the mill in question. Theoretically, if milling is performed at a given percent of critical speed, with all other factors being equal, the size of the mill is not relevant.

Examination of the microstructure by known optical and scanning electron microscopy techniques of the powder produced using the above milling conditions, and the extruded microstructure, indicate that the matrix has a substantially uniform distribution of boron or $B_4C$ particles in a pure copper or aluminum oxide dispersion strengthened copper matrix. Substantially uniform distribution of the boron or $B_4C$ in the copper or aluminum oxide DSC matrix is an important quality in assuring that the composite material has optimum neutron radiation absorption and strength characteristics.

After the milling step, the resulting composite powders are then fully densified, preferably by an appropriate powder consolidation method, discussed above, such as hot extrusion. A preferred method of extrusion is as follows:

A composite powder, e.g., prepared by ball milling as described above, is loaded into a copper container and vibrated such that the tap density of the powder in the container is equal to or greater than 50% of theoretical density.

The procedure for the measurement of tap density is well established and is governed by the Metal Powder Industries Federation "Standard Test Methods for Metal Powders and Powder Metallurgy Products" Standard No. 46. Tap densities below 50% have been found to inhibit the ability to achieve full densification during extrusion and generate extrusion defects in the material.

The container with the composite powder is heated. The extrusion temperature ranges from 1400° to 1700° F. and the preferred temperature is 1650° F. The time at the temperature ranges from 30 to 120 minutes, with the best time depending on the size of the container.

The extrusion is performed at an extrusion ratio (cross-sectional area of the container to cross-sectional area of the extruded bar) of not less than 15:1. A typical extrusion ratio for extrusions performed in the laboratory is 17:1. While the maximum ratio cannot be established because it is controlled by extrusion press capacity, the extrusion ratio can be as high as 100:1. The preferred ratio is from 25:1 to 50:1.

Preferably, extrusion dies are preheated to a temperature of 900° F. plus or minus 50° F.

Metallographic examination of extruded bars indicates that the above procedure results in 1) full dense extruded microstructure and 2) the elemental boron or boron carbide is substantially uniformly distributed throughout the copper or DSC matrix. Extruded bars are examined using known metallographic practices for copper and copper alloys, and known optical and scanning electron microscopy techniques. The absence of visible porosity at 400X magnification generally indicates that the material is fully dense within the limits defined earlier. Uniformity of the boron distribution is judged via microscopy.

EXAMPLE 1

Pure copper powder was combined with 1.5 weight percent elemental boron powder utilizing a ball milling procedure characterized by the following parameters: a charge to media weight ratio of 1:5; spherical steel media of ¼", ½", and ¾" diameters; media volume of 25% of the total mill volume; rotational speed of 55 rpm (60% of the critical mill speed); and total milling time of 12 hours.

The composite powder product was examined microscopically and it was observed that the pure copper powder matrix contained a substantially uniform distribution of elemental boron. This powder was placed in a copper extrusion can such that the tap density of the composite powder was greater than 50%. The filled can was preheated at 1650° F. for 30 minutes, and extruded using a 17:1 extrusion ratio. Extrusion dies were preheated to 900° F.

A bar of pure copper (without boron) was extruded under the same conditions.

Mechanical tests were performed on declad samples of each of the extruded bars. "Declad" refers to the composite product from which the copper extrusion container has been removed. The composite powder is contained in a copper can during the extrusion process. The properties of the extruded bar made of the elemental copper/1.5 weight percent boron composite are shown compared to extruded elemental copper without boron:

| Composite | UTS (psi) | YS (psi) | Elongation (% in 1") | Hardness RB | Electrical Conduct. (% IACS) |
|---|---|---|---|---|---|
| Copper/1.5 wt % boron | 41,000 | 28,000 | 22 | 46 | 78 |
| Copper/no boron | 35,000 | 13,000 | 39 | 43 | 95 |

The extruded bar of copper without boron and the extruded bar of the composite containing boron have comparable mechanical properties, except that the boron containing material has about twice the yield strength and marginally superior hardness. The addition of boron results in a reduced elongation and electrical conductivity. The thermal conductivity of the composite of the copper with 1.5 weight percent boron will have about 75–80% of the thermal conductivity of pure copper.

EXAMPLE 2

A composite containing aluminum oxide (0.3 weight percent) DSC (GLIDCOP AL-15, as discussed above) and 1.5 weight percent boron powder was produced by a ball milling process similar to that described in Example 1. The composite powder was consolidated into a full dense bar using the hot extrusion process of Example 1. Examination of the microstructure indicates that the 0.3 weight percent aluminum oxide DSC/1.5 weight percent boron composite was characterized by a uniform distribution of elemental boron in the DSC matrix.

A bar of aluminum oxide DSC (without boron) was extruded under the same conditions.

The properties of the extruded bar of 0.3 weight percent aluminum oxide DSC/1.5 weight percent boron bar are shown compared to extruded 0.3 weight percent aluminum oxide DSC without boron:

| Composite | UTS (psi) | YS (psi) | Elongation (% in 1") | Hardness RB | Electrical Conduct. (% IACS) |
|---|---|---|---|---|---|
| DSC with 1.5 wt % Boron | 63,000 | 49,000 | 14 | 71 | 77 |
| DSC without Boron | 67,000 | 58,000 | 16 | 68 | 92 |

The extruded bar of DSC without boron and the extruded bar of the composite containing boron have comparable mechanical properties, with the boron-free material having slightly higher strengths and elongation, and the composite having marginally superior hardness. The addition of boron results in a reduced electrical conductivity. The thermal conductivity of the composite of Example 2 is also estimated to be about 75–80% of pure copper.

It will be apparent to one skilled in the art that various modifications and equivalents may be employed in practicing this invention. No limitations are to be inferred or implied except as specifically set forth in the claims.

What is claimed is:

1. An essentially fully densified composite material comprising:

a dispersion-strengthened copper as a first phase;

a boron constituent as a second phase, wherein said boron constituent is elemental boron or boron carbide; said boron constituent being substantially uniformly distributed throughout the dispersion-strengthened copper, the proportion of said boron constituent being at least about 0.5 percent by weight of the material.

2. The material of claim 1 wherein said dispersion strengthened copper is metal oxide dispersion strengthened copper.

3. The material of claim 2 wherein said metal oxide is aluminum oxide.

4. The material of claim 1 wherein said boron constituent is from about 0.5 to about 3.0 percent by weight of the material.

5. The material of claim 4 wherein said boron constituent is about 1.5 percent by weight of the material.

6. A composite material for use in fabricating nuclear waste containers for supporting spent nuclear fuel and absorbing neutron radiation, said material comprising:

a dispersion-strengthened copper as a first phase;

a boron constituent as a second phase, wherein said boron constituent is elemental boron or boron carbide; said boron constituent being substantially uniformly distributed throughout the dispersion-strengthened copper, the proportion of said boron constituent being at least about 0.5 percent by weight of the material;

said material being essentially fully densified.

7. The material of claim 6 wherein said dispersion strengthened copper is metal oxide dispersion strengthened copper.

8. The material of claim 7 wherein said metal oxide is aluminum oxide.

9. The material of claim 6 wherein said boron constituent is from about 0.5 to about 3.0 percent by weight of the material.

10. The material of claim 9 wherein said boron constituent is about 1.5 percent by weight of the material.

11. A process for manufacturing a composite material of a dispersion-strengthened copper as a first phase and a boron constituent as a second phase, wherein said boron constituent is elemental boron or boron carbide, the proportion of said boron constituent being at least about 0.5 percent by weight of the material, said process comprising the steps of:

a. mixing a powder of the dispersion-strengthened copper with a powder of the boron constituent to provide a composite powder with said boron constituent substantially uniformly distributed throughout the copper constituent; and b. essentially fully densifying said composite powder.

12. The process of claim 11 wherein said dispersion strengthened copper is metal oxide dispersion strengthened copper.

13. The material of claim 12 wherein said metal oxide is aluminum oxide.

14. The process of claim 11 wherein said boron constituent is from about 0.5 to about 3.0 percent by weight of the material.

15. The process of claim 14 wherein said boron constituent is about 1.5 percent by weight of the material.

16. The process of claim 11 wherein the constituent powders are mixed in a powder blender.

17. The process of claim 11 wherein the constituent powders are mixed in a high energy mill.

18. The process of claim 17 wherein said high energy mill is a ball mill.

19. The process of claim 11 wherein said composite powder is fully densified by a method comprising the following steps:

a. loading said composite powder into a copper container;

b. vibrating said container until the tap density of said composite powder is equal to or greater than 50 percent of theoretical density of the composite powder;

c. heating said container;

d. extruding the composite powder through an extension die at an extrusion ratio of not less than 15:1.

20. The process of claim 19 wherein said container is heated to between 1400° to 1700° F.

21. The process of claim 20 wherein said container is heated to 1650° F.

22. The process of claim 19 wherein said container is heated for 30 to 120 minutes.

23. The process of claim 19 wherein said extrusion die is heated.

24. The process of claim 23 wherein said extrusion die is heated to between 850° to 950° F.

25. The process of claim 19 wherein said composite powder is extruded in the form of a bar.

* * * * *